US009920476B2

(12) United States Patent
Niemi et al.

(10) Patent No.: US 9,920,476 B2
(45) Date of Patent: Mar. 20, 2018

(54) ARRANGEMENT AND METHOD IN SODA RECOVERY BOILER

(71) Applicant: Valmet Technologies Oy, Espoo (FI)

(72) Inventors: Piia Niemi, Jyvaeskylae (FI); Markku Isoniemi, Tampere (FI); Tero Juutilainen, Nokia (FI); Kari Haaga, Tampere (FI)

(73) Assignee: Valmet Technologies Oy, Espoo (FI)

( * ) Notice: Subject to any disclaimer, the term of this patent is extended or adjusted under 35 U.S.C. 154(b) by 244 days.

(21) Appl. No.: 14/428,884

(22) PCT Filed: Sep. 18, 2013

(86) PCT No.: PCT/FI2013/050902

§ 371 (c)(1),
(2) Date: Mar. 17, 2015

(87) PCT Pub. No.: WO2014/044911

PCT Pub. Date: Mar. 27, 2014

(65) Prior Publication Data

US 2015/0275427 A1 Oct. 1, 2015

(30) Foreign Application Priority Data

Sep. 19, 2012 (FI) ..... 20125968

(51) Int. Cl.

| | |
|---|---|
| ***F23J 15/06*** | (2006.01) |
| ***D21C 11/12*** | (2006.01) |
| ***F22B 21/34*** | (2006.01) |
| ***F22G 1/02*** | (2006.01) |
| ***F22B 1/20*** | (2006.01) |

(52) U.S. Cl.
CPC ..... *D21C 11/12* (2013.01); *F22B 1/20* (2013.01); *F22B 21/343* (2013.01); *F22G 1/02* (2013.01)

(58) Field of Classification Search
CPC ..... F23J 15/06; F22G 1/02
See application file for complete search history.

(56) References Cited

U.S. PATENT DOCUMENTS 1,811,657 A * 6/1931 Wood ..... F23M 5/08 122/235.11
2,313,251 A 3/1943 Marshall
(Continued)

FOREIGN PATENT DOCUMENTS

EP 1188986 A2 3/2002
EP 1728919 A1 12/2006
(Continued)

OTHER PUBLICATIONS

European Patent Office, Extended European Search Report for Application No. 13839478.8, dated May 31, 2016, 9 pages, Germany.

(Continued)

*Primary Examiner* — Nathaniel Herzfeld
(74) *Attorney, Agent, or Firm* — Alston & Bird LLP

(57) ABSTRACT

An arrangement and a method in a soda recovery boiler, in a furnace (1) of which recovery boiler there are arranged screen tubes (7) and which recovery boiler comprises a second pass (9) in which is arranged at least one superheater (4'). The second pass (9) is arranged for being cooled with cooling medium coming from the screen tubes (7).

14 Claims, 7 Drawing Sheets

(56) References Cited

U.S. PATENT DOCUMENTS

| | | | | | |
|---|---|---|---|---|---|
| 2,867,195 | A * | 1/1959 | Hauck | F22B 21/341 | 122/240.2 |
| 2,946,669 | A | 7/1960 | Coulter, Jr. | | |
| 3,548,788 | A * | 12/1970 | Altman | F22B 29/067 | 122/406.4 |
| 3,760,774 | A * | 9/1973 | Michel | F22B 37/146 | 122/510 |
| 4,442,800 | A * | 4/1984 | Seifert | F22B 21/345 | 122/379 |
| 5,299,534 | A * | 4/1994 | Janka | F22G 7/14 | 122/20 B |
| 5,787,844 | A * | 8/1998 | Paju | F22B 31/045 | 122/379 |
| 5,950,574 | A * | 9/1999 | Matsuda | F22G 7/14 | 122/460 |
| 6,178,924 | B1 * | 1/2001 | Hakulinen | D21C 11/12 | 122/235.33 |
| 6,609,482 | B2 * | 8/2003 | Ruohola | F22D 1/36 | 122/479.2 |
| 7,434,543 | B2 * | 10/2008 | Raukola | D21C 11/12 | 122/461 |
| 2006/0288963 | A1 * | 12/2006 | Raukola | D21C 11/12 | 122/7 R |

FOREIGN PATENT DOCUMENTS

| | | | |
|---|---|---|---|
| EP | 2003242 | A1 | 12/2008 |
| FI | 20002055 | A | 3/2002 |
| FI | 119332 | B | 10/2008 |
| FI | 201205968 | A | 3/2014 |
| JP | H05-039914 | | 2/1993 |
| WO | WO 1998/027384 | A1 | 6/1998 |
| WO | WO 2014/044911 | A1 | 3/2014 |

OTHER PUBLICATIONS

National Board of Patents and Registration of Finland, Search Report for Application No. 20125968, dated Jul. 8, 2013, 1 page, Finland.

National Board of Patents and Registration of Finland, Search Report for Application No. 20145399, dated Jun. 6, 2014, 1 page, Finland.

International Searching Authority, International Search Report and Written Opinion for International Application No. PCT/FI2013/050902, dated Dec. 23, 2013, 12 pages, National Board of Patents and Registration of Finland.

* cited by examiner

ARRANGEMENT AND METHOD IN SODA RECOVERY BOILER

CROSS REFERENCE TO RELATED APPLICATIONS

This application is a National Stage Application, filed under 35 U.S.C. § 371, of International Application No. PCT/FI2013/050902, filed Sep. 18, 2013, which claims priority to Finnish Application No. 20125968, filed Sep. 19, 2012; the contents of both of which as are hereby incorporated by reference in their entirety.

BACKGROUND

Related Field

Description of Related Art

The invention relates to an arrangement in a soda recovery boiler in a furnace of which recovery boiler there are arranged screen tubes and which recovery boiler comprises a second pass in which is arranged at least one superheater.

Further, the invention relates to a method in a soda recovery boiler.

In a pulp production process black liquor is burnt in a soda recovery boiler. The functions of the recovery boiler include recovery of chemicals and recovery of thermal energy generated in combustion.

The recovery boiler includes a furnace into which the black liquor and air needed for combustion are fed. In the upper part of the boiler there are superheaters, and after the superheater area a flue gas duct. The flue gas duct encompasses a boiler bank and economizers. By the thermal energy generated in combustion there is produced superheated, pressurized steam that may be used in production of electricity, inter alia.

When the temperature of the superheated steam is to be raised, some of the superheaters may be arranged in a second pass, i.e. in a first duct part of the flue gas duct after the boiler. As a result the temperature of the surfaces in the second pass may rise excessively.

BRIEF SUMMARY

The arrangement and method in a soda recovery boiler according to the invention are characterised by what is stated in the characterising parts of the independent claims. Other embodiments of the invention are characterised by what is stated in the other claims.

Inventive embodiments are also disclosed in the specification and drawings of this patent application. The inventive content of the patent application may also be defined in other ways than those defined in the following claims. The inventive content may also be formed of several separate inventions, especially if the invention is examined in the light of expressed or implicit sub-tasks or in view of obtained benefits or benefit groups. In such a case, some of the definitions contained in the following claims may be unnecessary in view of the separate inventive ideas. Features of the different embodiments of the invention may within the scope of the basic inventive idea be applied to other embodiments.

The arrangement of the invention is characterized in that the second pass is arranged for being cooled with cooling medium coming from screen tubes.

An advantage is that the second pass in the hot area will be cooled efficiently. A further advantage is that cooling circulation in the screen tubes will be secured.

The method of the invention is characterized in that the soda recovery boiler comprises a second pass, screen tubes arranged in a furnace and at least one superheater arranged in the second pass, the method cooling the second pass with cooling medium conveyed from the screen tubes.

An advantage is that the temperature in the second pass will be curbed in an efficient and simple manner.

In the following, features of some embodiments of the invention are listed in a random order:

The idea of an embodiment is that an ash hopper in the second pass comprises a ring casing that is arranged in the lower part of the ash hopper and connected with a connection pipe to the screen tubes to receive the cooling medium and to distribute the cooling medium to front wall cooling pipes and rear wall cooling pipes of the ash hopper. An advantage is that the cooling medium will be distributed evenly in different cooling pipes.

The idea of an embodiment is that the cooling pipes in the ash hopper provide gastight front and rear walls of the ash hopper and that higher up the cooling pipes are arranged to provide grid tubes to allow flue gases to pass through. An advantage is that the ash hopper will be cooled very efficiently and that higher up thermal energy in the flue gases will be recovered.

The idea of an embodiment is that the cooling pipes of the front and/or rear wall form a closed ceiling for the second pass and that they are connected to the second upper header and therethrough to a drum. An advantage is that thermal energy in the flue gases will also be recovered from the ceiling of the second pass.

The idea of an embodiment is that side walls of the second pass are connected to steam circulation in order to cool the side walls. An advantage is that said side walls may be employed as a superheater.

The idea of an embodiment is that the cooling circulation of the recovery boiler is implemented as natural circulation and that the front wall cooling pipes and the rear wall cooling pipes of the ash hopper in the second pass are arranged as a whole higher up than the screen tubes. An advantage is that the cooling circulation is simple to implement and it works reliably.

The idea of an embodiment is that cooling medium from the screen tubes is arranged to be conveyed to at least one side wall of the second pass. An advantage is that the side wall will be cooled.

The idea of an embodiment is that at least one side wall in the second pass is connected with a downcomer pipe to the drum to receive cooling water. An advantage is that cooling of the second pass and recovery of thermal energy will be enhanced.

BRIEF DESCRIPTION OF THE FIGURES

The matter will be described in greater detail in the attached drawings, in which.

DETAILED DESCRIPTION OF VARIOUS EMBODIMENTS

Figure 1:
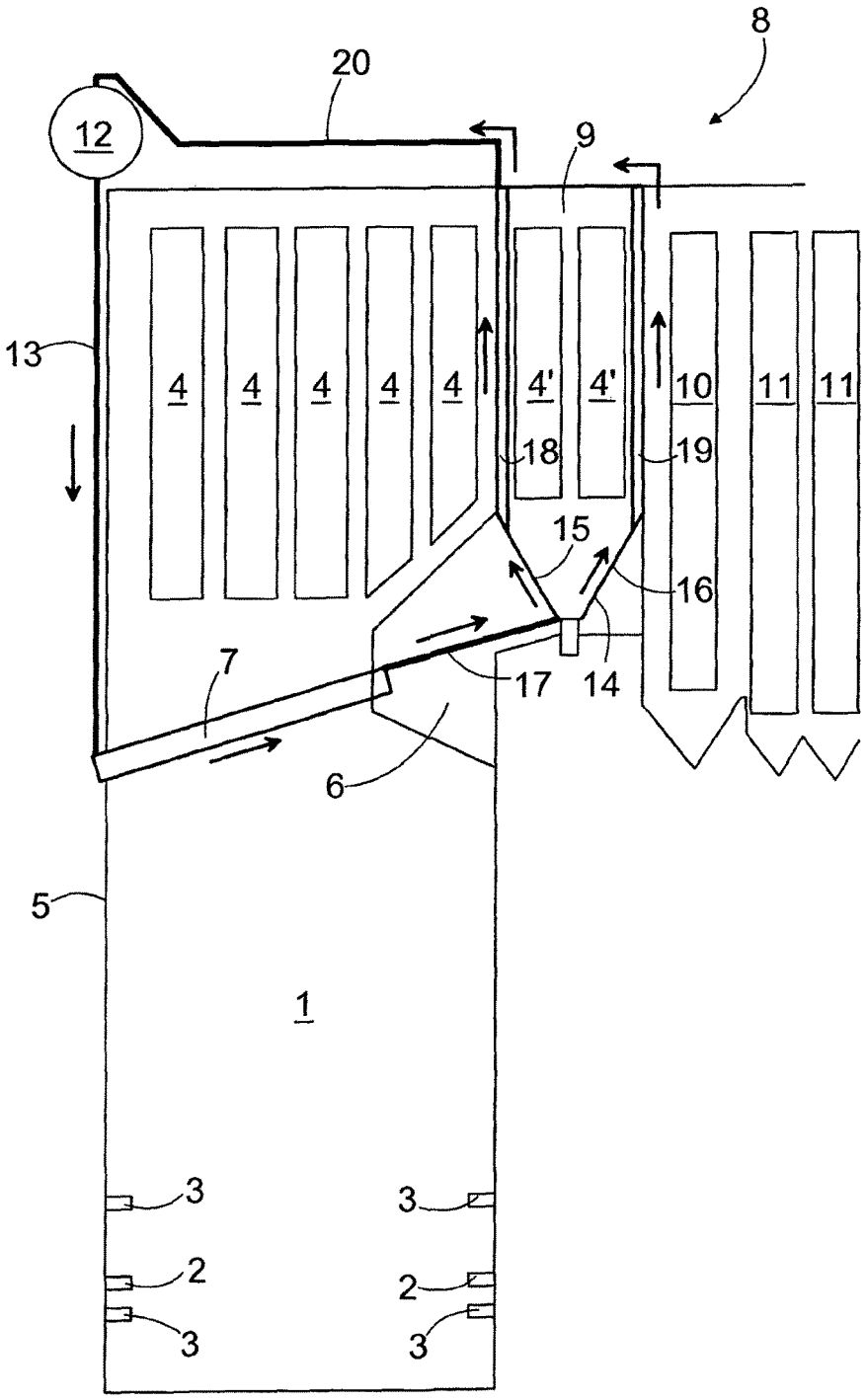
FIG. 1 is a schematic side view of a soda recovery boiler, partly cut open.

In the figures, the matter is shown simplified for the sake of clarity. Like reference numerals refer to like parts in the figures.

DETAILED DESCRIPTION

FIG. 1 is a schematic side view of a recovery boiler, partly cut open. The recovery boiler includes a furnace 1 where black liquor is fed through nozzles 2 so as to be burnt. Combustion air is fed into the furnace 1 through air nozzles 3.

In the upper part of the furnace 1 of the recovery boiler there are arranged heat surfaces 4, which are superheaters. The superheaters 4 are elements consisting of a plurality of adjacent, vertical tubes, a plural number of which elements are side by side in the transverse direction of the recovery boiler. Steam flows in the superheaters, which steam becomes hot as hot flue gases heat the tubes from outside.

The recovery boiler comprises a nose 6 guiding the flow of the flue gases. At the nose 6 and below the superheaters 4 there are screen tubes 7. The screen tubes 7 are disposed with relatively wide spacing and in the tubes circulates water that partly vaporizes by the effect of the flue gases bypassing the screen tubes. Correspondingly, this makes the temperature of the flue gases fall before they arrive at the superheaters 4. In addition the screen tubes 7 protect the superheaters 4 from direct radiation from the furnace.

The screen tubes 7 are, in general, of a vaporizing surface and they operate by natural circulation. The screen tubes are arranged at an angle deviating from a horizontal plane in such a way that their ends closest to the nose 6 are higher up than the ends further away.

The walls 5, the superheaters 4 and the screen tubes 7 of the recovery boiler are so-called heat surfaces. The heat surfaces indicated by reference numeral 4' may be, for instance, superheaters or screen tubes. These heat surfaces comprise either pipes that are apart from one another or they form gastight walls, like boiler walls 5, provided by welding. Inside these heat surfaces flows water or steam or a mixture thereof, which is heated by the effect of external combustion or hot gases.

The flue gases flow after the upper part of the furnace 1 to convection heat surfaces 8, which comprise successive duct parts that communicate with one another through their ends. The first of these duct parts is a second pass 9.

In the second pass 9 there are arranged superheaters 4'. These superheaters 4' allow the temperature of superheated steam to be raised in comparison with the solution, in which superheaters are only in the upper part of the recovery boiler. Thanks to this, it is possible to produce steam having a temperature of 515° C., for instance.

The second pass 9 comprises an ash hopper 14 the purpose of which is to collect ash and through which the ash will be removed from the second pass 9.

The ash hopper 14 comprises a cooled front wall 15 and a cooled rear wall 16, by means of which the temperature of the surfaces in the ash hopper 15 will be lowered. The structure and operation of the cooled front and rear walls 15, 16 will be discussed in greater detail later on in the text. With the cooled front and rear walls the temperature on the ash hopper surfaces can be lowered such that it is possible to reduce a risk of them being damaged.

The convection heat surfaces 8 after the second pass 9 typically comprise more heat surfaces, for instance boiler banks 10 and economizers 11 known per se.

The recovery boiler further comprises a water and steam system. It includes a drum 12 wherefrom warm water is conveyed, inter alia, into the screen tubes 7 through a downcomer 13. The figure shows only one downcomer 13, but naturally their number may also be higher.

The screen tubes 7 are connected with one or more connection pipes 17 to the front wall cooling pipes 15 and the rear wall cooling pipes 16 of the ash hopper 14 of the second pass. In other words, the cooling pipes 15, 16 of the ash hopper 14 of the second pass are connected to receive cooling medium from the screen tubes 7. The cooling medium to be received is typically a mixture of water and steam.

The cooling pipes 15, 16 of the ash hopper 14 are connected via the front wall grid tubes 18 and the rear wall grid tubes 19 to a circulation tube 20 and further to the drum 12. The grid tubes 19, 20 comprise tubes arranged at least substantially vertically and with a mutual spacing, between which flue gas is able to flow onwards. The figure shows only one circulation tube 20, but naturally their number may also be higher. The cooling medium, which has warmed in the screen tubes 7, the cooling pipes 15, 16 and the grid tubes 18 and which is steam or a mixture of water and steam, is thus conveyed back into the drum 12 or to a next superheater step.

If the cooling circulation of the recovery boiler is implemented as so-called natural circulation, the front wall cooling pipes 15 and the rear wall cooling pipes 16 of the ash hopper 14 of the second pass are preferably arranged, as a whole, higher up than the screen tubes 7, whereby the connection pipe 17 is rising in the flow direction of the cooling medium and the natural circulation is realized in an efficient manner.

It should be noted that for ease of illustration the attached figures do not show all the pipes of the water and steam system communicating with the heat surfaces. In practice, however, several downcomers may run to the heat surfaces and several circulations tubes may run from the heat surface to the drum.

Figure 2A:
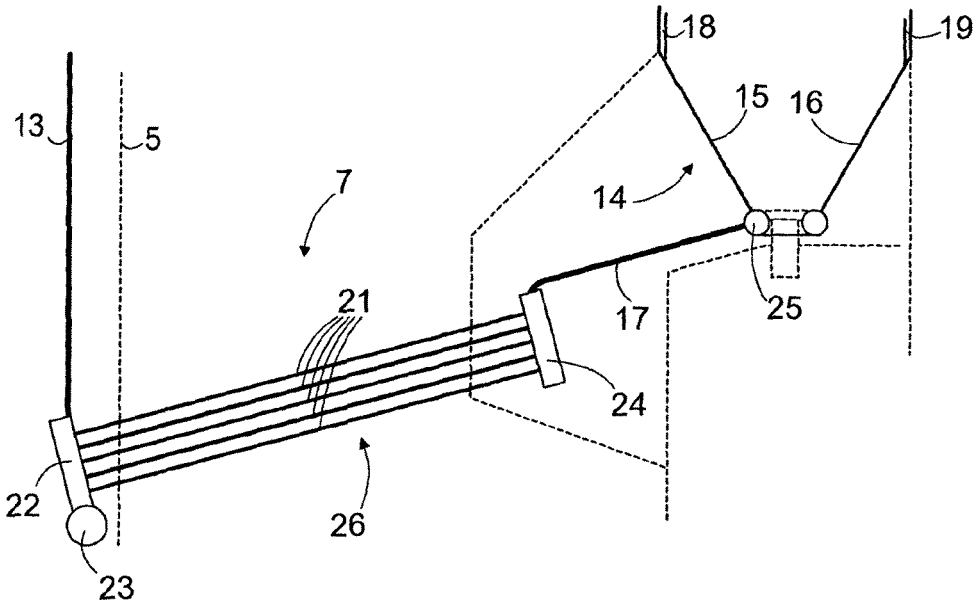
FIG. 2*a* is a schematic side view of screen tubes and a second pass ash hopper of a soda recovery boiler, partly cut open.
Figure 2B:
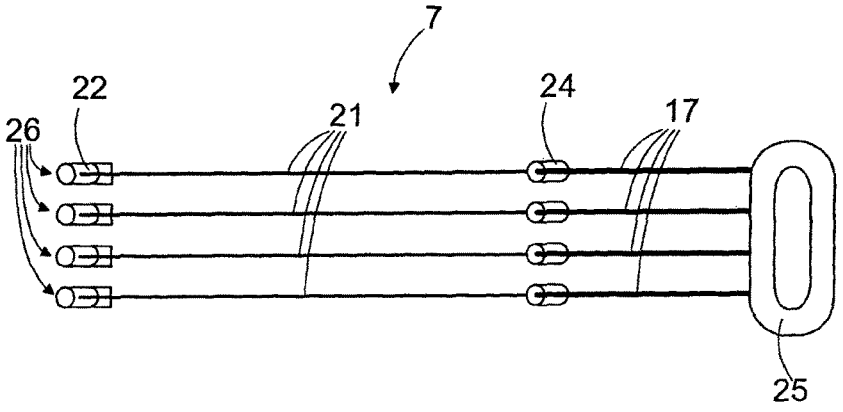
FIG. 2*b* is a top view of the screen tubes and the second pass ash hopper of FIG. 2*a*, partly cut open.

FIG. 2*a* shows schematically screen tubes of a recovery boiler and an ash hopper of a second pass connected thereto, in side view and partly cut open, and FIG. 2*b* shows them in top view and partly cut open.

The screen tubes 7 comprise a set of heat surface pipes 21 that are grouped into pipe elements 26. In the embodiment of the figure each pipe element 26 comprises five heat surface pipes 21; however, it is clear that said number as well as the number of pipe elements 26 may also be other than that.

The screen tubes 7 comprise a supply header 23 that distributes the incoming cooling medium into element supply headers 22. From the element supply header 22 cooling medium is distributed to the heat surface pipes 21. The cooling medium exiting the heat surface pipes 21 is conveyed via an element collection header 24 to the connection pipe 17.

The cooling system of the ash hopper 14 of the second pass comprises an ash hopper supply header, for instance a ring casing 25, to which each pipe element 26 is connected with a specific connection pipe 17. According to another idea, two or more pipe elements 26 are connected to a common connection pipe 17.

The ring casing 25 is arranged in the lower part of the ash hopper 14 and it distributes the cooling medium coming from the screen tubes 7 to the front wall cooling pipes 15 and the rear wall cooling pipes 16. According to another idea, the arrangement does not include a supply header of the ash hopper, but the connection pipes 17 are connected to the cooling pipes 15, 16, for instance, via separate chambers.

The ash hopper 14 is thus cooled with cooling medium the temperature of which is relatively low. Hence, the ash hopper 14 is subjected to efficient cooling effect.

The cooling medium flows, after the ash hopper 14, from the front wall cooling pipes 15 of the ash hopper into the front wall grid tubes 18, and correspondingly, from the rear wall cooling pipes 16 of the ash hopper into the rear wall grid tubes 19.

Figure 3A:
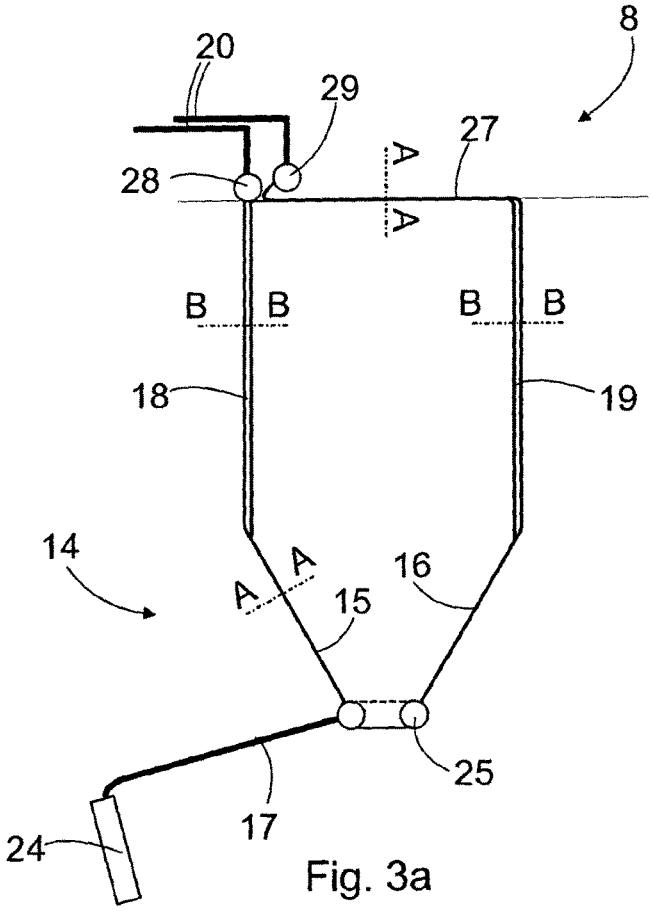
FIG. 3*a* is a schematic side view of a second pass ash hopper, partly cut open.
Figure 3B:
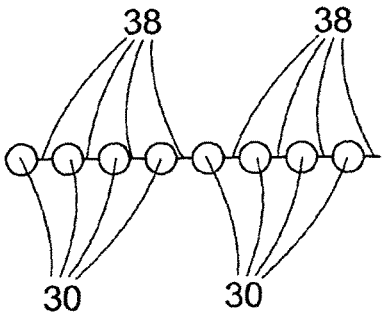
FIG. 3*b* shows first cross sections of the ash hopper of FIG. 3*a*.
Figure 3C:
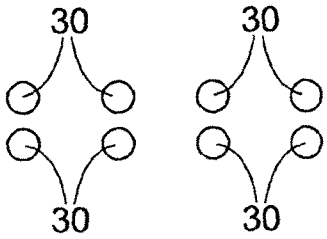
FIG. 3*c* shows second cross sections of the ash hopper of FIG. 3*a*.

FIG. 3*a* shows schematically an ash hopper of the second pass, in side view and partly cut open, FIG. 3*b* shows first cross sections A-A of the ash hopper and FIG. 3*c* second cross sections B-B.

The cooling pipes 15, 16 interconnected with fins 38 provide the gastight front and rear walls of the ash hopper 14, as shown in FIG. 3*b*. A structure of this kind may be manufactured by welding, for instance. Naturally, a gastight structure may also be provided in a manner other than that, for instance, by connecting adjacent cooling pipes 30 directly to one another. The sides of ash hopper 14 are delimited by the side walls of the second pass 8.

Above the ash hopper 14, the cooling pipes are grouped in a grid form to provide front wall grid tubes 18 and rear wall grid tubes 19. A cross section of a grid form is shown in FIG. 3*c*. Naturally, the grid form may also be other than that, with the proviso that the cooling pipes 30 are arranged in a spaced manner so that it allows flue gases to flow through.

The cooling pipes 15, 16 of the ash hopper may be connected via the front wall grid tubes 18 and the rear wall grid tubes 19 to one or more collection headers 28, 29 and further to the circulation tube 20 and the drum 12.

The front and/or rear wall grid tubes 18, 19 may form a gastight ceiling 27 of the second pass, the cross section of the ceiling following the principle shown in FIG. 3*b*. In that case the ceiling 27 also serves as a heat surface. FIG. 3*a* shows an embodiment in which the rear wall grid tubes 19 form a gastight ceiling 27 of the second pass.

According to an idea, the cooling pipes of the ceiling 27 are connected via the collection header 28, 29 and the circulation tube 20 to the drum 12.

It should be noted, however, that the above-described ceiling solution and/or the collection header 28, 29 may be omitted from the arrangement.

Figure 4:
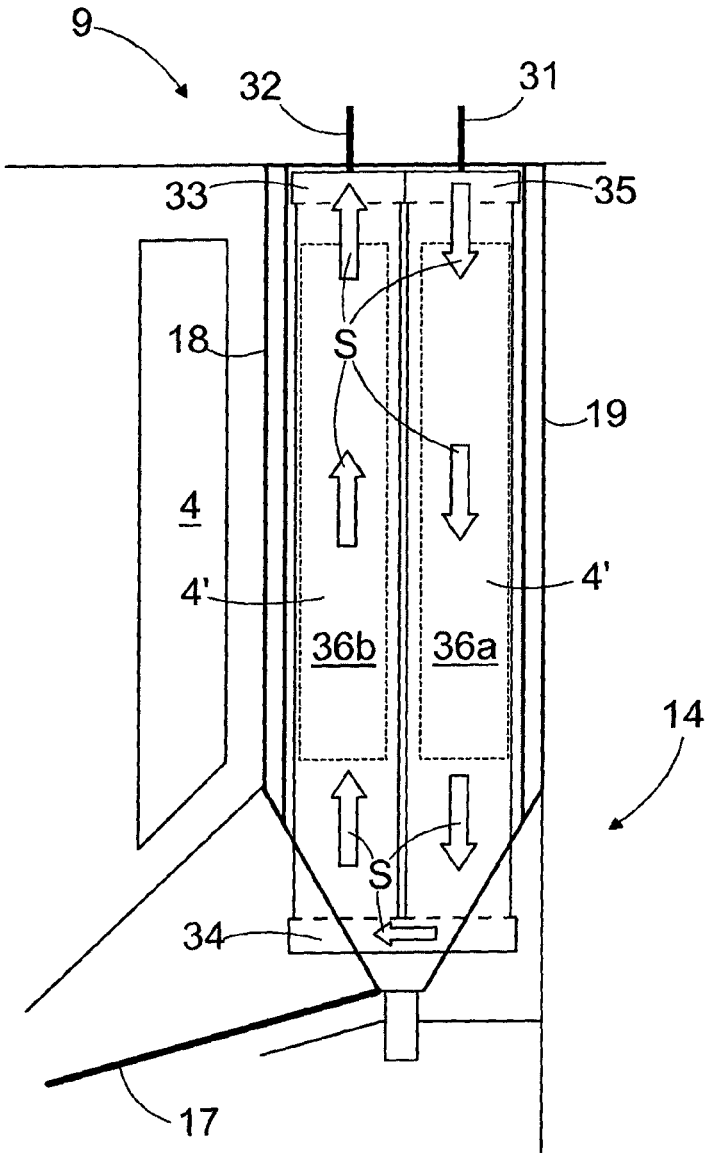
FIG. 4 is a schematic side view of a side wall structure in a second pass of a soda recovery boiler, partly cut open.

FIG. 4 is a schematic side view of a side wall structure of a second pass in a recovery boiler, partly cut open.

According to an idea, the side walls of the second pass 9 are connected to steam circulation in order to cool the side walls and to serve at the same time as superheaters.

In the solution shown in FIG. 4 the steam is fed from a drum through a steam feed pipe 31 and discharged through a steam exhaust pipe 32 to the superheaters.

Steam, the flow direction of which is indicated by arrows S, flows down from a first upper header 33 arranged in the upper part of the second pass 9 into a lower header 34 arranged in the lower part of the second pass 9 and therefrom further up into a second upper header 35 arranged in the upper part of the second pass 9.

Between the first upper header and the lower header 33, 34 there is arranged a first side wall superheater 36*a*, and between the lower header and the second upper header 34, 35 a second side wall superheater 36*b*.

According to an idea, the cross section of the side wall superheater 36*a*, 36*b* is as shown in FIG. 3*b*.

It should be noted, however, that according to a second idea the side walls of the second pass 9 are cooled by circulating cooling medium on a natural circulation principle in pipes arranged in the side walls.

Figure 5:
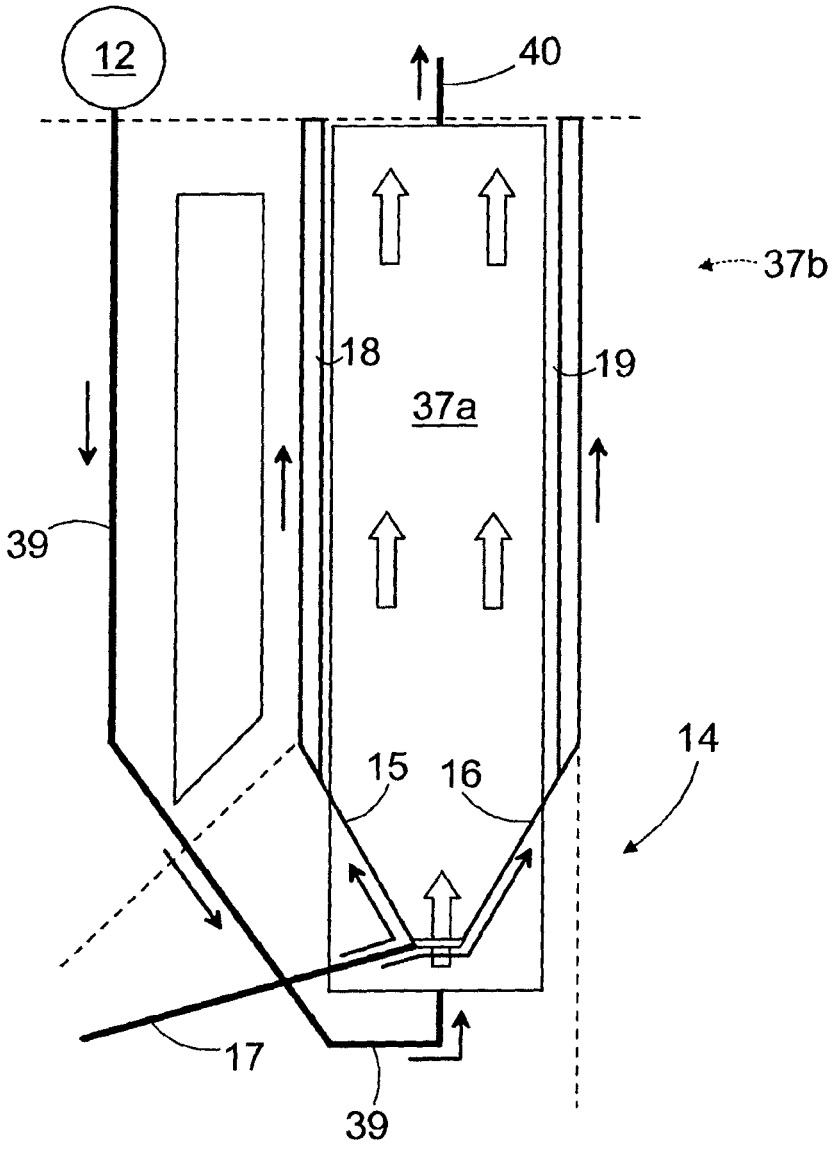
FIG. 5 is a schematic side view of a second structure of a second pass of a soda recovery boiler, partly cut open.

FIG. 5 is a schematic side view of a structure of a second pass in a recovery boiler, partly cut open.

The connection pipe 17 conveys cooling medium from the screen tubes, not shown in the figure, to the front and rear walls 15, 16 of the ash hopper 14 of the second pass, wherefrom it rises into the front wall grid tubes 18 and the rear wall grid tubes 19 and so on, in accordance with the principles presented earlier in this description.

At least one of the side walls 37*a*, 37*b* of the second pass comprise cooling pipes, by means of which the second pass will be cooled. It should be noted that FIG. 5 shows only the first of the side walls 37*a* of the second pass: the second side wall 37*b* is located on the opposite side thereto in the second pass.

The cooling pipes of the side wall 37*a*, 37*b* are connected via at least one side wall downcomer 39 to the drum 12. The side wall downcomer 39 conveys cooling medium, which in this case is water, into the cooling pipes of the side wall 37*a*, 37*b*.

By cooling the side wall 37*a*, 37*b* cooling of the second pass and recovery of thermal energy will be enhanced.

Figure 6:
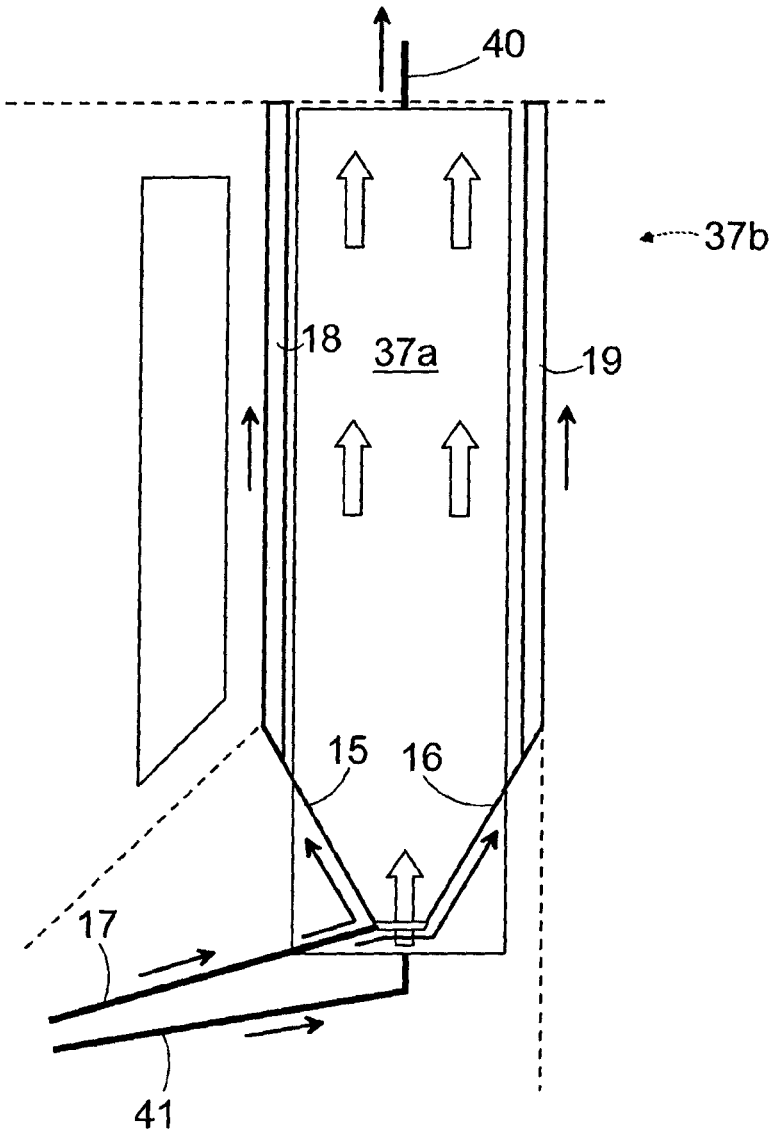
FIG. 6 is a schematic side view of a third structure of a second pass of a soda recovery boiler, partly cut open.

FIG. 6 is a schematic side view of a third structure of a second pass in a recovery boiler, partly cut open.

Here, at least one of the side walls 37*a*, 37*b* of the second pass comprises cooling pipes which are connected with at least one side wall connection pipe 41 to the screen tubes. In this manner the cooling medium from the screen tubes will be conveyed not only to the front and rear walls 15, 16 of the ash hopper 14 through the connection pipe 17, but also to at least one of the side walls 37*a*, 37*b* of the second pass.

An advantage of the solution is the increased capacity of the cooling pipes of the second pass to receive the cooling medium from the screen tubes. Hence, the volume flow of the cooling medium through the screen tubes may be increased.

Figure 7:
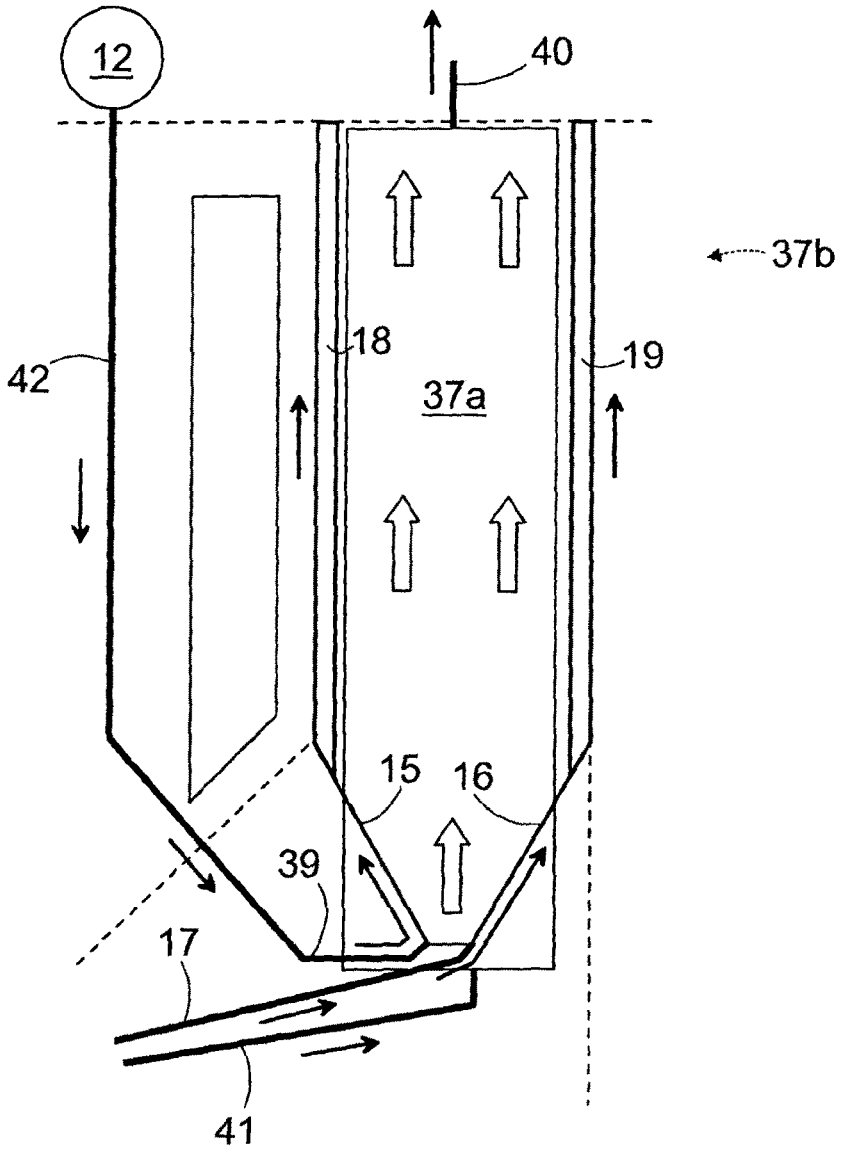
FIG. 7 is a schematic side view of a fourth structure of a second pass of a soda recovery boiler, partly cut open.

FIG. 7 is a schematic side view of a fourth structure of a second pass in a recovery boiler, partly cut open.

Like in the solution of FIG. 6, also here at least one of the side walls 37*a*, 37*b* of the second pass comprises cooling pipes which are connected with at least one side wall connection pipe 41 to the screen tubes. The screen tubes are further connected with the connection pipe 17 to the cooling pipes of the rear wall 16 of the ash hopper 14, but not to the cooling pipes of the front wall 15. The cooling pipes of the front wall 15 are, instead, connected with at least one downcomer 42 of the ash hopper to the drum 12. In other words, the front wall 15 of the ash hopper is cooled with cooling medium, e.g. water, coming from the drum 12, and the rear wall 16 of the ash hopper is cooled with cooling medium, which is typically water or a mixture of water and steam, coming from the screen tubes.

An advantage of the solution is that cooling capacity of the second pass will be further increased.

In this connection it should be noted that according to an idea the drum 12 is connected through the ash hopper downcomer 42 only to the cooling pipes of the rear wall 16 of the ash hopper. In that case the cooling pipes of the front wall 15 may be cooled with cooling medium from the screen tubes.

According to a second idea, the drum 12 is connected through the ash hopper downcomer 42 both to the cooling pipes of the front wall 15 and to the cooling pipes of the rear wall 16. In that case, at least one of the side walls 37*a*, 37*b* of the second pass comprises cooling pipes which are connected with at least one side wall connection pipe 41 to receive cooling medium from the screen tubes.

According to a third idea, the front wall 15 or the rear wall 16 of the ash hopper is implemented without cooling, and the cooling of the second pass is implemented by cooling the opposite wall 15, 16 of the ash hopper and/or at least one of the side walls 37*a*, 37*b* of the second pass with cooling medium from the screen tubes 7.

In some cases, features disclosed in this application may be used as such, regardless of other features. On the other hand, when necessary, features disclosed in this application may be combined in order to provide various combinations.

The drawings and the relating description are only intended to illustrate the idea of the invention. It is apparent to a person skilled in the art that the invention is not restricted to the embodiments described above, in which the invention is described by means of some examples, and many modifications and different embodiments of the invention are possible within the scope of the inventive idea defined in the following claims.

REFERENCE NUMERALS

1 furnace
2 black liquor nozzle
3 air nozzle
4, 4' heat surface
5 wall
6 nose
7 screen tubes
8 convection heat surface
9 second pass
10 boiler bank
11 economizer
12 drum
13 downcomer
14 ash hopper of second pass
15 front wall of ash hopper
16 rear wall of ash hopper
17 connection pipe
18 front wall grid tubes
19 rear wall grid tubes
20 circulation tube
21 heat surface pipe
22 element supply header
23 supply header
24 element collection header
25 ring casing
26 tube element
27 ceiling of second pass
28 first collection header
29 second collection header
30 cooling pipe
31 steam feed pipe
32 steam exhaust pipe
33 first upper header
34 lower header
35 second upper header
36*a, b* side wall superheater
37*a, b* side wall of second pass
38 fin
39 side wall downcomer
40 cooling medium discharge pipe
41 side wall connection pipe
42 ash hopper downcomer
S passage of steam

The invention claimed is:

1. An arrangement in a soda recovery boiler comprising:
a furnace comprising arranged screen tubes,
a second pass comprising a second pass ash hopper, the second pass ash hopper comprising at least one of front wall cooling pipes or rear wall cooling pipes, and
at least one superheater arranged in the second pass,
wherein:
the second pass is cooled with cooling medium coming from the screen tubes,
the front wall cooling pipes and/or the rear wall cooling pipes are connected to receive the cooling medium from the screen tubes, and
the cooling pipes of the ash hopper form a gastight front and/or rear wall of the ash hopper.

2. The arrangement of claim 1, wherein the second pass ash hopper comprises an ash hopper supply header that is arranged in the lower part of the ash hopper and connected with a connection pipe to the screen tubes to receive cooling medium and to distribute the cooling medium into said front wall cooling pipes and/or rear wall cooling pipes.

3. The arrangement of claim 1, wherein the cooling pipes of the ash hopper are, higher up, arranged to provide grid tubes so as to allow flue gases to pass through.

4. The arrangement of claim 3, wherein the cooling pipes form a gastight ceiling for the second pass and are connected via a collection header to a drum.

5. The arrangement of claim 2, wherein the cooling pipes of the ash hopper are, higher up, arranged to provide grid tubes so as to allow flue gases to pass through.

6. The arrangement of claim 5, wherein the cooling pipes form a gastight ceiling for the second pass and that they are connected via a collection header to a drum.

7. The arrangement of claim 1, wherein in that cooling medium from the screen tubes is arranged for being conveyed to at least one side wall of the second pass.

8. The arrangement of claim 1, wherein at least one side wall of the second pass is connected with a downcomer to the drum to receive cooling water.

9. The arrangement of claim 1, wherein at least one side wall of the second pass is connected to steam circulation so as to cool the side walls.

10. The arrangement claim 1, wherein the screen tubes comprise tube elements including superimposed heat surface pipes, each of the tube elements being connected with a specific connection pipe to the second pass.

11. A method in a soda recovery boiler, the method comprising the steps of:
providing a soda recovery boiler comprising:
a second pass comprising a second pass ash hopper,
screen tubes arranged in a furnace, and
at least one superheater arranged in the second pass, and
cooling the second pass with cooling medium conveyed from the screen tubes, wherein:

the cooling medium is conveyed to at least one of a front wall or a rear wall of the second pass ash hopper from the screen tubes, and the cooling pipes of the ash hopper form a gastight front and/or rear wall of the ash hopper.

12. The method of claim 11, wherein the cooling medium from the screen tubes is conveyed to at least one side wall of the second pass.

13. The method of claim 11, wherein cooling water from a drum is conveyed to at least one side wall of the second pass.

14. The method of claim 11, wherein side walls of the second pass are connected to steam circulation of the boiler.

* * * * *